US009400461B1

(12) United States Patent
Yokoyama et al.

(10) Patent No.: US 9,400,461 B1
(45) Date of Patent: Jul. 26, 2016

(54) FIXING DEVICE AND IMAGE FORMING APPARATUS

(71) Applicant: FUJI XEROX CO., LTD., Tokyo (JP)

(72) Inventors: Yuki Yokoyama, Kanagawa (JP); Kazuhiko Arai, Kanagawa (JP); Kazunori Numao, Kanagawa (JP); Atsumi Kurita, Kanagawa (JP); Masayo Higashimura, Kanagawa (JP); Keitaro Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/833,855

(22) Filed: Aug. 24, 2015

(30) Foreign Application Priority Data

Jan. 28, 2015 (JP) ..... 2015-013817

(51) Int. Cl.
*G03G 21/20* (2006.01)
*G03G 15/20* (2006.01)

(52) U.S. Cl.
CPC ..... *G03G 15/2028* (2013.01); *G03G 21/206* (2013.01)

(58) Field of Classification Search
CPC ..... G03G 15/201; G03G 9/09; G03G 2215/0119; G03G 7/00; G03G 8/00; G03G 9/0926; G03G 9/09741; G03G 15/6585; G03G 21/04; G03G 2215/00805; G03G 2215/0081; G03G 2215/0132; G03G 7/0013
See application file for complete search history.

(56) References Cited

U.S. PATENT DOCUMENTS

2009/0016765 A1* 1/2009 Honda ..... G03G 15/6573 399/94
2014/0147148 A1 5/2014 Kiuchi

FOREIGN PATENT DOCUMENTS

| | | | |
|---|---|---|---|
| EP | 2169468 | A3 | 2/2011 |
| JP | 2005221652 | A | 8/2005 |
| JP | 2005300980 | A | 10/2005 |
| JP | 2007199383 | A | 8/2007 |
| JP | 2009244533 | A | 10/2009 |
| JP | 2010-78659 | A | 4/2010 |
| JP | 2013130754 | A | 7/2013 |
| JP | 2014106340 | A | 6/2014 |
| JP | 2014191278 | A | 10/2014 |

OTHER PUBLICATIONS

Communication dated Aug. 18, 2015 from the Japanese Patent Office in counterpart application No. 2015-013817.
Communication dated Nov. 17, 2015 from the Japanese Patent Office in counterpart application No. 2015-013817.

* cited by examiner

*Primary Examiner* — Roy Y Yi
(74) *Attorney, Agent, or Firm* — Sughrue Mion, PLLC

(57) ABSTRACT

A fixing device includes a heating unit that heats an unfixed image on a recording medium, which is deformed by heating, and hence fixes the unfixed image; and a transport member that closely contacts a no-image surface of the recording medium and transports the recording medium while causing a close contact force to act on the recording medium against a deformation force, which is generated at the recording medium by the heating of the heating unit. The close contact force of the recording medium with respect to the transport member is larger than the deformation force generated at the recording medium.

8 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-013817 filed Jan. 28, 2015.

BACKGROUND

The present invention relates to a fixing device and an image forming apparatus.

SUMMARY

According to an aspect of the invention, there is provided a fixing device including a heating unit that heats an unfixed image on a recording medium, which is deformed by heating, and hence fixes the unfixed image; and a transport member that closely contacts a no-image surface of the recording medium and transports the recording medium while causing a close contact force to act on the recording medium against a deformation force, which is generated at the recording medium by the heating of the heating unit. The close contact force of the recording medium with respect to the transport member is larger than the deformation force generated at the recording medium.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings.

First Exemplary Embodiment

Figure 1:
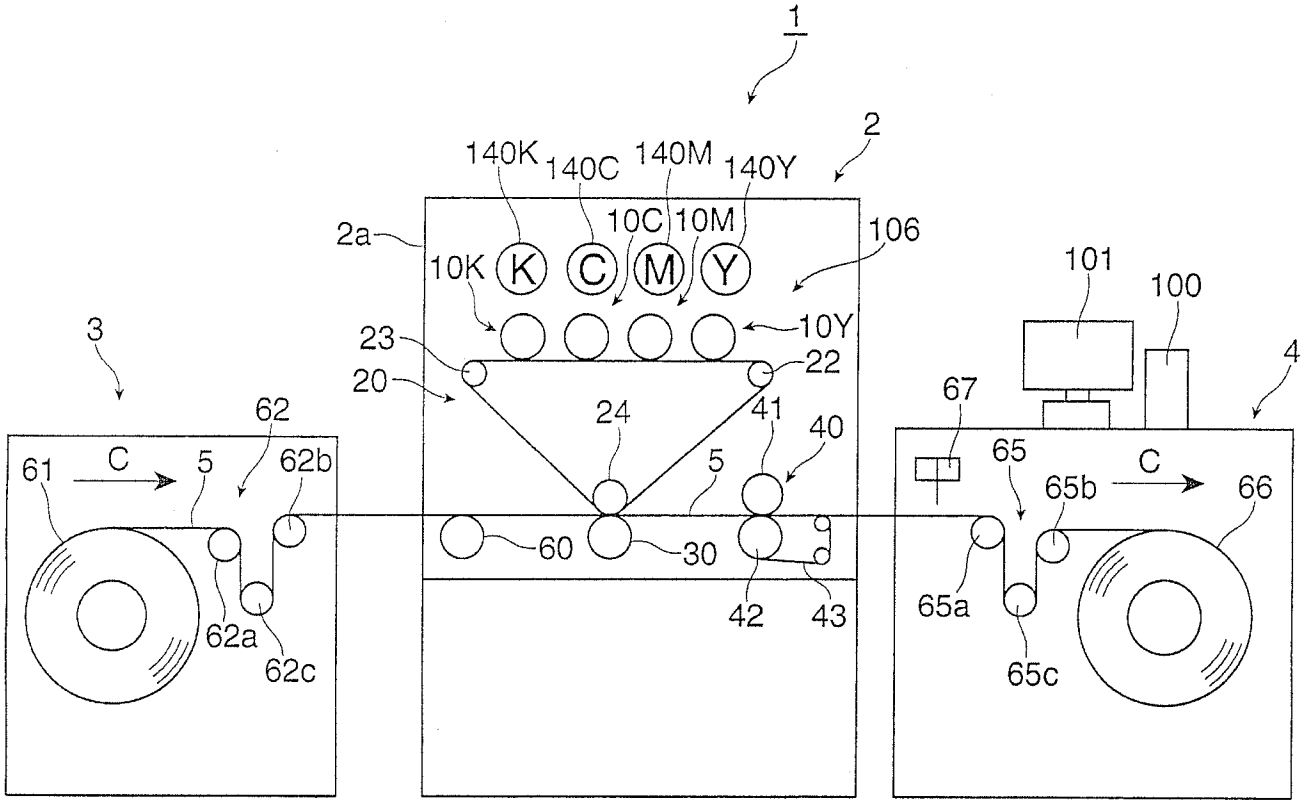
FIG. 1 is a general configuration diagram showing an image forming apparatus to which a fixing device according to a first exemplary embodiment of the invention is applied.

FIG. 1 is a configuration diagram showing an overview of an image forming apparatus to which a fixing device according to a first exemplary embodiment of the invention is applied.

General Configuration of Image Forming Apparatus

An image forming apparatus 1 according to the first exemplary embodiment is configured as, for example, a color printer. The image forming apparatus 1 includes an image output device 2 that forms images by using four-color toners of yellow (Y), magenta (M), cyan (C), and black (K); a supply device 3 that supplies a continuous sheet 5 as an example of a recording medium; a housing device 4 that houses the continuous sheet 5 having images formed by the image output device 2; and a control device 100 that is provided with a user interface 101 on the housing device 4 and controls the image output device 2, the supply device 3, and the housing device 4. In the image forming apparatus in the illustrated example, the supply device 3, the housing device 4, and the control device 100 are separately arranged outside the image output device 2. However, in the image forming apparatus 1, at least one or all of the image output device 2, the supply device 3, the housing device 4, and the control device 100 may be integrally arranged.

The image output device 2 includes an image forming unit 106 of electrophotographic system, as an example of an image forming section that forms an image (unfixed image) on a recording medium in accordance with image data. The image forming unit 106 includes plural imaging devices 10 that forms toner images developed with toners configuring developers, an intermediate transfer device 20 that holds the toner images respectively formed by the imaging devices 10 and transports the toner images to a second transfer position at which the toner images are finally second transferred on the continuous sheet 5, and a guide device 60 that guides a predetermined portion of the continuous sheet 5 to be supplied to the second transfer position of the intermediate transfer device 20. Also, the image output device 2 includes a fixing device 40 according to this exemplary embodiment at the downstream side of the second transfer position of the intermediate transfer device 20 in a transport direction of the continuous sheet 5.

The image output device 2 may be configured as, for example, a color copier if the image output device 2 additionally includes an image reading device as an image reading unit (not shown) that inputs a document image to be formed on the continuous sheet 5. Reference sign 2*a* in the drawing denotes a housing of the image output device 2. The housing 2*a* includes a support configuration member, an outer covering part, etc.

The imaging devices 10 include four imaging devices 10Y, 10M, 10C, and 10K that respectively dedicatedly form toner images of four colors including yellow (Y), magenta (M), cyan (C), and black (K). The four imaging devices 10 (Y, M, C, K) are arranged in a row at equivalent intervals in the inner space of the housing 2*a*.

Figure 2:
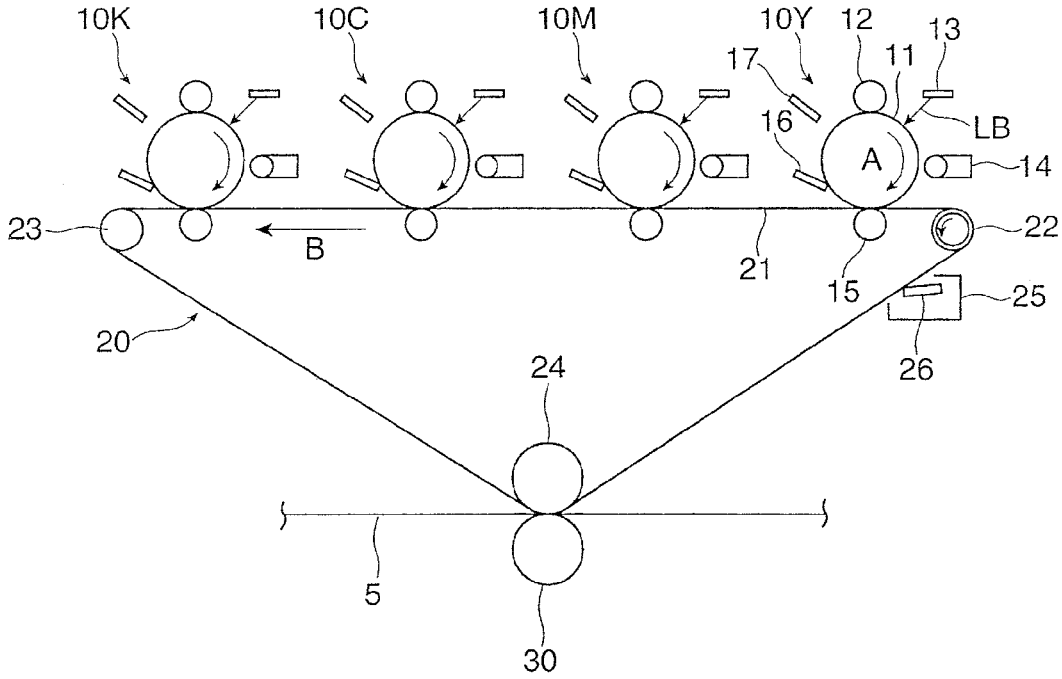
FIG. 2 is a configuration diagram showing an image forming unit of the image forming apparatus according to the first exemplary embodiment of the invention.

As shown in FIG. 2, each imaging device 10 includes a photoconductor drum 11 as an example of a rotating image holding body. Major devices are arranged around the photoconductor drum 11 as follows. The major devices include a charging device 12 that electrically charges the peripheral surface (image holding surface), on which an image may be formed, of the photoconductor drum 11 to have predetermined potential; an exposure device 13 serving as an electrostatic latent image forming unit that irradiates the electrically charged peripheral surface of the photoconductor drum 11 with light in accordance with information (signal) of an image and hence forms an electrostatic latent image (for each color) having a potential difference; a developing device 14 serving as an example of a developing unit that develops the electrostatic latent image with a toner of a developer of a corresponding color and hence forms a toner image; a first transfer device 15 that transfers each toner image on the intermediate transfer device 20; a drum cleaning device 16 that removes an adhering substance such as a toner remaining on and adhering to the image holding surface of the photoconductor drum 11 after the first transfer and hence cleans up the image holding surface of the photoconductor drum 11; and an electricity eliminating device 17 that eliminates remaining electric charge by exposing the surface of the photoconductor drum 11 to light.

The photoconductor drum 11 includes a cylindrical or columnar grounded base member and an image holding surface having a photoconductive layer (photosensitive layer) made of a photosensitive material formed on the peripheral surface of the base member. The photoconductor drum 11 is supported to rotate in a direction indicated by arrow A when receiving a power transmitted from a rotationally driving device (not shown).

The charging device 12 includes a contact charging roller arranged in a contact state with the photoconductor drum 11. The charging device 12 is supplied with a charging voltage. As the charging voltage, if the developing device 14 executes reversal development, voltage or current with the same polarity as the charging polarity of the toner to be supplied from the developing device 14 is supplied. Alternatively, the charging device 12 may be a non-contact charging device such as a scorotron etc. arranged in a non-contact state with respect to the surface of the photoconductor drum 11.

The exposure device 13 irradiates the peripheral surface of the electrically charged photoconductor drum 11 with light LB, which is configured in accordance with information of an image input to the image output device 2, and hence forms an electrostatic latent image. In latent-image formation, information (signal) of an image input by a desirable unit to the image output device 2 and processed by an image processor (not shown) in the control device 100 is transmitted to the exposure device 13.

Each developing device 14 includes, in a housing having an opening and a developer housing chamber, a development roller that holds a developer and transports the developer to a development region facing the photoconductor drum 11, two stir and transport members such as screw augers (not shown) that transport the developer to supply the developer to the development roller while stirring the developer, and a layer-thickness limit member (not shown) that limits the amount of developer (layer thickness) held on the development roller. The developing device 14 is supplied with a developing bias voltage between the development roller and the photoconductor drum 11 from a power supply device (not shown). Also, the development roller and the stir and transport members receive powers transmitted from a rotationally driving device (not shown) and rotate in predetermined directions. As the developer, for example, a two-component developer containing a non-magnetic toner and a magnetic carrier is used.

In FIG. 1, reference sign 140 (Y, M, C, K) denotes toner cartridges serving as developer housing containers that house developers containing at least toners that are respectively supplied to the corresponding developing devices 14. In this exemplary embodiment, the toner cartridge 140 houses only a toner therein.

The first transfer device 15 is a contact transfer device including a first transfer roller that rotates by contacting the peripheral surface of the photoconductor drum 11 through the intermediate transfer belt 21 and that is supplied with a first transfer voltage. As the first transfer voltage, a direct-current voltage with reverse polarity reverse to the charging polarity of the toner is supplied from a power supply device (not shown).

The drum cleaning device 16 includes a container-shaped body (not shown) partly having an opening; a cleaning plate that is arranged in contact with the peripheral surface of the photoconductor drum 11 with a predetermined pressure after the first transfer, that removes an adhering substance such as a remaining toner, and hence cleans up the peripheral surface of the photoconductor drum 11; and a collecting device that collects the adhering substance removed by the cleaning plate.

The electricity eliminating device 17 includes a light-emitting diode or a light-emitting lamp that eliminates electric charge remaining on the surface of the photoconductor drum 11 by exposing the surface of the photoconductor drum 11 to light.

As shown in FIGS. 1 and 2, the intermediate transfer device 20 is arranged below the imaging devices 10 (Y, M, C, K). The intermediate transfer device 20 includes an intermediate transfer belt 21 that rotates in a direction indicated by arrow B while passing through first transfer positions between the photoconductor drums 11 and the first transfer devices 15 (the first transfer rollers); plural belt support rollers 22 to 24 that hold the intermediate transfer belt 21 from its inner periphery in a desirable state and rotatably supports the intermediate transfer belt 21; a second transfer device 30 that is arranged at the outer peripheral surface (the image holding surface) side of the intermediate transfer belt 21 supported by the belt support roller 24 and that second transfers toner images on the intermediate transfer belt 21 onto a continuous sheet 5; and a belt cleaning device 25 having a blade-shaped cleaning member (cleaning blade) 26 that removes an adhering substance, such as a toner or paper dust, remaining on and adhering to the outer peripheral surface of the intermediate transfer belt 21 after the intermediate transfer belt 21 passes through the second transfer device 30.

The intermediate transfer belt 21 may use an endless belt fabricated with a material in which a resistance control agent such as carbon black is dispersed in a synthetic resin, such as polyimide resin or polyamide resin. Also, the belt support roller 22 is configured as a driving roller, the belt support roller 23 is configured as a tension applying roller, and the belt support roller 24 is configured as a backup roller for second transfer.

As shown in FIG. 1, the second transfer device 30 is a contact transfer device having a second transfer roller that rotates by contacting the peripheral surface of the intermediate transfer belt 21 and that is supplied with a second transfer voltage, at a second transfer position being a portion of the outer peripheral surface of the intermediate transfer belt 21 supported by the support roller 24 in the intermediate transfer device 20. Also, the second transfer roller of the second transfer device 30 or the support roller 24 of the intermediate transfer device 20 is supplied with a direct-current voltage as a second transfer voltage having reverse polarity reverse to or the same polarity as the toner charging polarity.

The guide device 60 is configured of a guide roller arranged to rotate in a contact state with the no-image surface of the continuous sheet 5. The guide device 60 guides the continuous sheet 5 while regulating the position of the continuous sheet 5 transported to the second transfer position.

The fixing device 40 includes a heating rotating body 41 in a roller form or a belt form heated by a heating unit so that the surface temperature is held at a predetermined temperature; a pressing rotating body 42 in a roller form that rotates by contacting the heating rotating body 41 with a predetermined pressure; and a transport member 43 in a belt form or roller form that closely contacts the no-image surface (back surface) of the continuous sheet 5 and transports the continuous sheet 5. The details of the fixing device 40 are described later.

As shown in FIG. 1, the supply device 3 is arranged in a separate state as an individual body at the upstream side of the image output device 2 in the transport direction of the continuous sheet 5. The supply device 3 includes a supply roller 61 in which the continuously formed long continuous sheet 5 as an example of a recording medium is wound in a roll shape. The continuous sheet 5 may be, for example, a thin film or sheet having a thickness in a range from about 10 to about 100 μm and made of a synthetic resin that is deformed (shrunk or elongated) by heating, such as polystyrene (PS), polyvinyl chloride (PVC), polyethylene (PE), polypropylene (PP), polyethylene terephthalate (PET), or styrene-butadiene block copolymer (SBR). The continuous sheet 5 is used as, for example, a wrapping film that covers a wrapped container serving as a product to be wrapped such as a plastic bottle, by forming an image (including coloring etc. of a background part) entirely or partly on the surface. However, the continuous sheet 5 may be used for other purposes.

After the image is formed on the front surface or the back surface of the continuous sheet 5 as required, the continuous sheet 5 is fixed in a state wound around the outer peripheral surface of the wrapped container such as a plastic bottle, is heated by applying hot air or the like or placing the wrapped container in a high-temperature environment, and hence is deformed (shrunk) into a shape following the outside shape of the wrapped container. Thus heating and shrinking (shrinking) processing for covering the wrapped container is executed. Owing to this, the continuous sheet 5 is previously applied with one-axis elongating processing (elongation in one direction such as the width direction being a direction intersecting with the transport direction) or two-axis elongating processing (elongation in two directions such as the width direction and the transport direction). In this exemplary embodiment, a film made of polystyrene (PS) with a thickness of 50 μm applied with one-axis processing (elongation in the width direction being the direction intersecting with the transport direction) is used as the continuous sheet 5. Alternatively, the recording medium may be made of paper etc. as long as the recording medium is deformed by heating. This continuous sheet 5 is deformed when dipped in hot water at predetermined temperatures for 10 seconds. With hot water at 70° C., the continuous sheet 5 is deformed by −1.0% in the longitudinal direction (transport direction) and 10.5% in the lateral direction (width direction). With hot water at 80° C., the deformation is −1.5% in the longitudinal direction and 33.0% in the lateral direction. With hot water at 100° C., the deformation is 9.5% in the longitudinal direction and 73.0% in the lateral direction. (The physical properties table of the functional film "EPS45TD" manufactured by C. I. Kasei Co., Ltd.) Referring to the signs indicating the deformation ratios, the plus represents that the continuous sheet 5 is shrunk, and the minus represents that the continuous sheet 5 is elongated. The above-described values are merely an example, and of course, the deformation ratio may vary in accordance with the material, thickness, etc., of the continuous sheet 5. The deformation ratio is obtained by, for example, an expression as follows:

$$\text{Deformation ratio}=\{[(\text{length before deformation})-(\text{length after deformation})]/(\text{length before deformation})\}\times 100(\%)$$

The supply device 3 includes a tension applying unit 62 that applies a tension to the continuous sheet 5 supplied by rotation of the supply roller 61, in addition to the supply roller 61 rotationally driven clockwise in a C direction by a driving unit (not shown). The tension applying unit 62 includes transport rollers 62*a* and 62*b* that transport the continuous sheet 5, and a tension applying roller 62*c* that is arranged between the transport rollers 62*a* and 62*b* and receives an elastic force applied in a direction to move away from the transport rollers 62*a* and 62*b*.

Also, the housing device 4 that houses the continuous sheet 5 having an image formed by the image output device 2 is arranged at the downstream side of the image output device 2 as an individual body at a position separated from the image output device 2. The housing device 4 includes a tension applying unit 65 that applies a tension to the continuous sheet 5, and a winding roller 66 that is arranged rotatably clockwise in the C direction and winds up the continuous sheet 5 in a roll shape. The tension applying unit 65 includes transport rollers 65*a* and 65*b* that transport the continuous sheet 5, and a tension applying roller 65*c* that is arranged between the transport rollers 65*a* and 65*b* and receives an elastic force applied in a direction to move away from the transport rollers 65*a* and 65*b*. A cutting device 67 that cuts the continuous sheet 5 as required is provided at an entrance portion of the housing device 4.

Basic Operation of Image Forming Apparatus

A basic image forming operation by the image forming apparatus 1 is described below.

In this case, an image forming operation of forming a full-color image formed by combining toner images of the four colors (Y, M, C, K) by using the four imaging devices 10 (Y, M, C, K) is described. Before the image forming operation is started, the continuous sheet 5 from the supply roller 61 of the supply device 3 is previously wound around the winding roller 66 of the housing device 4 through the transport path in the image output device 2.

When the image forming apparatus 1 receives command information of a request for an image forming operation (print), the four imaging devices 10 (Y, M, C, K), the intermediate transfer device 20, the second transfer device 30, the fixing device 40, etc., are activated.

Then, in each imaging device 10 (Y, M, C, K), the photoconductor drum 11 is rotated in the direction indicated by arrow A, and the charging device 12 electrically charges the surface of the corresponding photoconductor drum 11 to predetermined polarity (in the first exemplary embodiment, minus polarity) and potential. Then, the exposure device 13 irradiates the electrically charged surface of the photoconductor drum 11 with the light LB emitted in accordance with a signal of an image obtained by converting information of an image input to the image forming apparatus 1 into each of respective color components (Y, M, C, K), and hence forms an electrostatic latent image of each color component configured according to a predetermined potential difference on the surface.

Then, the developing devices 14 (Y, M, C, K) respectively supply the toners of the corresponding colors (Y, M, C, K) electrically charged to have predetermined polarity (minus polarity) and cause the toners to adhere to the electrostatic latent images of the respective color components formed on the photoconductor drums 11. With the development, the electrostatic latent images of the respective color components formed on the respective photoconductor drums 11 are visualized as toner images of the four colors (Y, M, C, K) developed with the toners of the corresponding colors.

Then, when the toner images of the respective colors formed on the photoconductor drums 11 of the respective imaging device 10 (Y, M, C, K) are transported to the first transfer positions, the first transfer devices 15 first transfer the toner images of the respective colors on the intermediate transfer belt 21 rotating in the direction indicated by arrow B of the intermediate transfer device 20 successively in a superimposed manner.

Also, in each imaging device 10 after the first transfer is ended, the drum cleaning device 16 removes an adhering substance by scraping the adhering substance and hence cleans up the surface of the photoconductor drum 11. Finally, the electricity eliminating device 17 eliminates electricity from the surface of the photoconductor drum 11 after the cleaning. Accordingly, each imaging device 10 is brought into a state available for the next imaging operation.

Then, the intermediate transfer device 20 holds the toner images first transferred by the rotation of the intermediate transfer belt 21 and transports the toner images to the second transfer position. Meanwhile, the supply device 3 sends out and supplies the continuous sheet 5 from the supply roller 61 in synchronization with the imaging operation to meet the transfer timing through the guide device 60. Since the continuous sheet 5 contacts the intermediate transfer belt 21 at the second transfer position, the continuous sheet 5 is transported toward the housing device 4 before image formation when the intermediate transfer belt 21 is driven.

At the second transfer position, the second transfer roller of the second transfer device 30 second transfers the toner images on the intermediate transfer belt 21 collectively on the continuous sheet 5. Also, in the intermediate transfer device 20 after the second transfer is ended, the belt cleaning device 25 removes an adhering substance such as a toner remaining on the surface of the intermediate transfer belt 21 after the second transfer and hence cleans up the surface of the intermediate transfer belt 21.

Then, the continuous sheet 5 with the toner images second transferred is separated from the intermediate transfer belt 21 and the second transfer roller of the second transfer device 30, and is transported to the fixing device 40. The fixing device 40 fixes the unfixed toner images to the continuous sheet 5 by introducing the continuous sheet 5 after the second transfer to the nip part between the rotating heating rotating body 41 and pressing rotating body 42 and causing the continuous sheet 5 to pass through the nip part, and hence by applying required fixing processing (heating and pressing). The continuous sheet 5 after the fixing is ended is wound around the winding roller 66 of the housing device 4.

With the above-described operation, the continuous sheet 5 having the full-color image formed by combining the toner images of the four colors is output.

Configuration of Fixing Device

Figure 3:
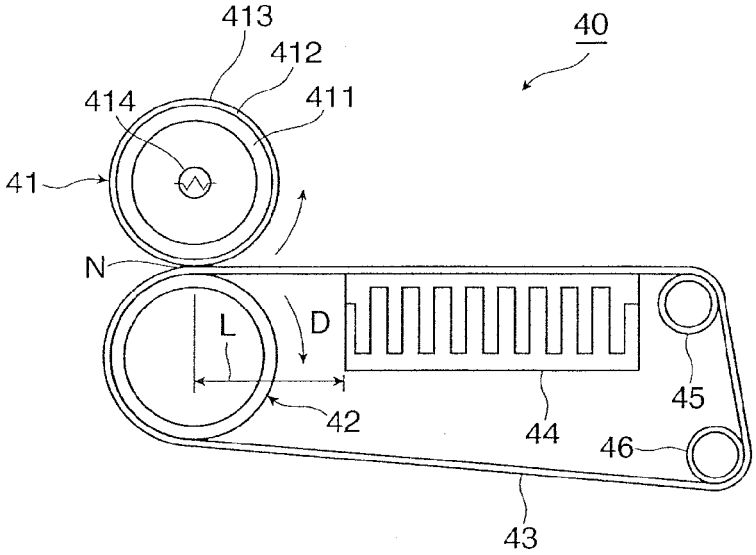
FIG. 3 is a configuration diagram showing the fixing device according to the first exemplary embodiment of the invention.

FIG. 3 is a configuration diagram showing the fixing device according to the first exemplary embodiment.

The fixing device 40 roughly include the heating roller 41 as an example of a heating unit (heating rotating body) that fixes an unfixed toner on a continuous sheet 5, which is deformed by heating; the pressing roller 42 as an example of a pressing unit that presses the continuous sheet 5 to the heating roller 41; the transport belt 43 as an example of an endless-belt-shaped transport member that closely contacts the no-image surface of the continuous sheet 5 and transports the continuous sheet 5; and a heat sink 44 as an example of a cooling unit that is arranged downstream of the heating roller 41 in the transport direction of the continuous sheet 5 and cools the continuous sheet 5 by contacting the no-image surface of the continuous sheet 5 through the transport belt 43. In this fixing device 40, a contact part where the heating roller 41 contacts (pressure contacts) the pressure roller 42 through the transport belt 43 serves as a fixing processing part N (nip part) that executes predetermined fixing processing (heating and pressing) including a heating process of heating the continuous sheet 5.

As shown in FIG. 3, the heating roller 41 includes a core metal member 411 formed in a cylindrical shape with metal such as aluminum, stainless steel, or iron; an elastic layer 412 made of a heat-resistant elastic body such as silicone rubber covering the surface of the core metal member 411 by a predetermined thickness; and a release layer 413 made of tetrafluoroethylene-perfluoroalkylvinilether copolymer (PFA) etc. covering the surface of the elastic layer 412. Also, the heating roller 41 includes a single halogen heater 414 or plural halogen heaters 414 (in the illustrated example, a single halogen heater 414) serving as a heat source that heats the surface of the heating roller 41 at a predetermined temperature (for example, in a range from about 150° C. to 180° C.). Further, a temperature sensor (not shown) is arranged in a contact manner on the surface of the heating roller 41 to detect and control the surface temperature of the heating roller 41 as required. The heating roller 41 rotates by following the pressing roller 42 through the transport belt 43.

The pressing roller 42 is formed of, for example, a cylindrical or columnar roller made of metal, such as aluminum, stainless steel, or iron. The pressing roller 42 may be configured such that the outer peripheral surface of the cylindrical or columnar roller is covered with an elastic layer (not shown) made of silicone rubber as required. The pressing roller 42 is attached to a frame (not shown) of the fixing device 40, and is rotationally driven at a predetermined speed in an arrow D direction by a driving unit (not shown). Also, the pressing roller 42 is arranged movably in a direction in which the pressing roller 42 comes into contact with the heating roller 41 and is separated from the heating roller 41 by a moving unit (not shown). The pressing force of the pressing roller 42 to the heating roller 41 is set at a predetermined value.

Figure 4:
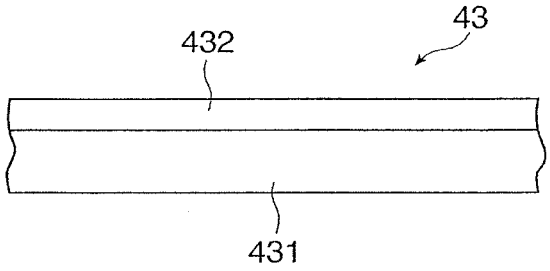
FIG. 4 is a cross-sectional configuration diagram showing a transport belt.

The transport belt 43 extends around the pressing roller 42 that holds the transport belt 43 from its inner periphery in a desirable state and rotatably supports the transport belt 43, and plural belt support rollers 45 and 46 with a predetermined tension (for example, 15 kgf). As shown in FIG. 4, the transport belt 43 includes a base member layer 431 made of a synthetic resin, such as polyimide resin, polyamide resin, or polyamideimide resin; and an elastic layer 432 made of liquid-form elastic polymer (product name "SIFEL" manufactured by Shin-Etsu Chemical Co., Ltd.) covering the surface of the base member layer 431 in a solidified state. Alternatively, the material forming the elastic layer 432 may be silicone rubber etc. The elastic layer 432 has a larger close contact force to the continuous sheet 5 than that of the base member layer 431 of the transport belt 43. The close contact force of the elastic layer 432 is determined by the material forming the elastic layer 432, the surface shape of the elastic layer 432, and so forth. The surface of the elastic layer 432 is formed in a mirror-surface state. The pressing roller 42 is configured as a driving roller that drives the transport belt 43, the belt support roller 45 is configured as a separating roller that separates the continuous sheet 5 from the transport belt 43, and the belt support roller 46 is configured as a tension applying roller that applies a tension to the transport belt 43.

To be more specific, the close contact force of the elastic layer 432 contains a friction force (static friction force) and an adhesive force. The friction force is proportional to a normal load acting on the surface of the elastic layer 432. A value obtained by dividing the friction force by the normal load is defined as a static friction coefficient at rest. An adhesive force resulting from the van der Waals force etc. acts between the back surface of the continuous sheet 5 and the surface of the elastic layer 432, in addition to the friction force. When friction is generated between metal (copper) and a synthetic resin (silicone) while decreasing the normal load and the relationship between the friction force and the normal load is measured, the friction force continuously acts even if the normal load becomes zero. This represents that the adhesive force acts at rest and during the friction. With such an experiment, the close contact force by which the back surface of the continuous sheet 5 closely contacts the surface of the elastic layer 432 contains the friction force and the adhesive force, and may be expressed by an expression as follows:

$$F=\mu(Fa+Ln),$$

where F is a close contact force, μ is a coefficient, and Ln is a normal load.

As described above, the close contact force in this exemplary embodiment is obtained by adding the adhesive force Fa and the friction force.

As shown in FIG. 3, the heat sink 44 is arranged downstream of the heating roller 41 in the moving direction of the continuous sheet 5, at the back surface (inner surface) of the transport belt 43 extending between the pressing roller 42 and the belt support roller 45, in a contact state with the transport belt 43. The heat sink 44 is an example of a cooling unit that cools the continuous sheet 5 through the transport belt 43. The heat sink 44 is arranged to extend from a position separated from the exit of the nip part N by a predetermined distance L to a position near the belt support roller 45, and to be present over the substantially entire width of the transport belt 43. To increase a cooling effect of the transport belt 43, an air-sending device including an air-sending fan (not shown) etc. that cools the transport belt 43 may be arranged together with the heat sink 44 or instead of the heat sink 44.

In this exemplary embodiment, since the continuous sheet 5 has characteristics of being deformed (shrunk) by heating as described above, by transporting the continuous sheet 5 passing through the heating roller 41 in a close contact state with the transport belt 43, the close contact force acts against the deformation force generated at the continuous sheet 5 by heating by the heating roller 41. Further, the fixing device 40 is desirably set so that a close contact force of the continuous sheet 5 with respect to the transport belt 43 is larger than the deformation force generated at the continuous sheet 5 in a direction along the surface of the continuous sheet 5 (the width direction).

The close contact force of the continuous sheet 5 with respect to the transport belt is measured and evaluated in conformance with a measurement method for 0° peeling (separating) adhesive force with respect to a test plate in "Plastics-Film and sheeting-Determination of the coefficients of friction" determined in JIS K 7125 as follows.

Figure 5:
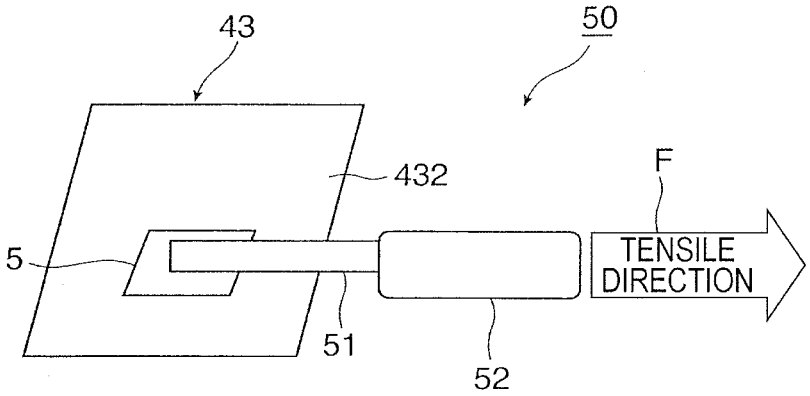
FIG. 5 is a schematic view showing a measurement method of a close contact force.

As shown in FIG. 5, a measurement device 50 is prepared. In the measurement device 50, a polystyrene (PS) film 5 as a recording medium formed in a 30×30-mm-square shape with a thickness of 50 μm is brought into close contact with the elastic layer 432 located on the surface of the transport belt 43 fixed to a flat plate (not shown) by applying a pressure to the film 5, the pressure being equivalent to the pressing force of the pressing roller 42 to the heating roller 41 of the fixing device 40. The measurement device 50 causes a tensile force F in a direction parallel to the surface of the film 5 (0° peeling direction) through a sheet-shaped or flat-plate-shaped narrow and long coupling jig 51 fixed by a method such as bonding with epoxy resin or the like on the surface of the film 5. The force (close contact force) required for peeling (separating) the film 5 from the elastic layer 432 of the surface of the transport belt 43 is measured by a digital stress sensor 52 (digital force gage). The read value (N) of the stress sensor 52 when the film 5 is separated from the elastic layer 432 at the surface of the transport belt 43 is considered as the close contact force (separation force). The same measurement is repeated plural times and an average value of the close contact forces when the film 5 is separated from the elastic layer 432 at the surface of the transport belt 43 is obtained as a measured value. At this time, the temperature of the surface of the transport belt 43 is changed to 40° C., 60° C., and 80° C. As the elastic layer 432 of the transport belt 43, a layer formed by applying and solidifying the product named "SIFEL" (2000 series) being liquid-form elastic polymer manufactured by Shin-Etsu Chemical Co., Ltd. is used.

Figure 6:
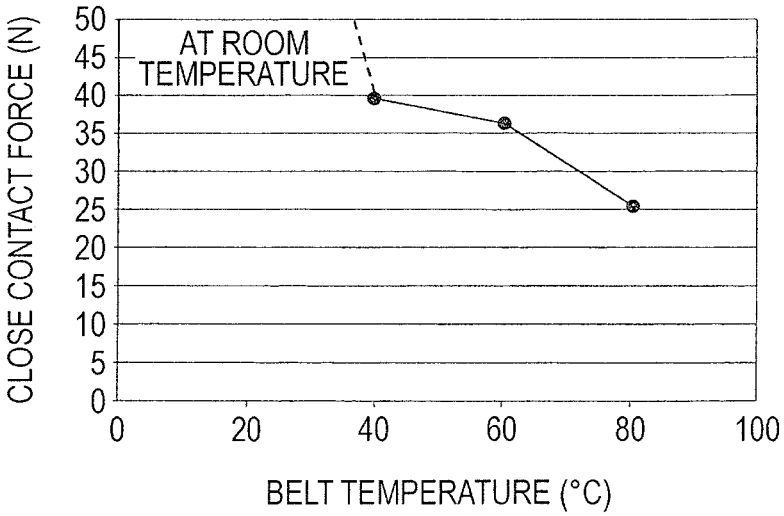
FIG. 6 is a graph showing a measurement result of the close contact force.

FIG. 6 is a graph showing the measurement result.

As it is found from the graph, the close contact force of the film 5 with respect to the elastic layer 432 of the transport belt 43 is about 39 (N) when the surface temperature of the transport belt 43 is 40° C., the close contact force is about 36 (N) when the surface temperature is 60° C., and the close contact force is about 26 (N) when the surface temperature is 80° C. The close contact force tends to increase as the temperature decreases. In a state in which the temperature of the transport belt 43 is cooled to a temperature close to a room temperature lower than 40° C., the close contact force of the film 5 with respect to the elastic layer 432 of the transport belt 43 is considered to rapidly increase as indicated by a broken line in FIG. 6 from about 39 (N).

Figure 7:
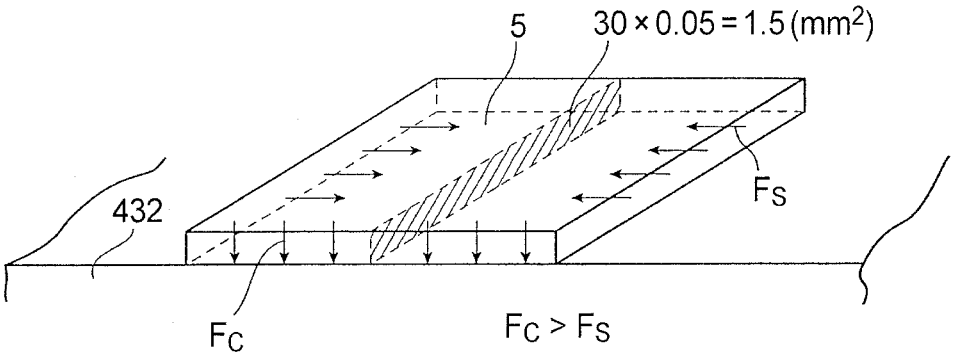
FIG. 7 is a schematic view showing a close contact force and a shrink force acting on a continuous sheet.

In case of a polystyrene film with a thickness of 50 μm (EPS45TD manufactured by C. I. Kasei Co., Ltd.), the deformation force (shrink stress) generated at the film 5 by heating is reported as the maximum value of 4.8 (N/mm$^2$) in the hot air at 85° C. (C. I. Kasei Co., Ltd., the physical properties table of the functional film). The deformation force (shrink force) $F_S$ generated at the film 5 is a stress generated in the film 5 when the film 5 is heated and hence shrunk as shown in FIG. 7. With regard to this, the deformation force (shrink force) $F_S$ acting on the 30-mm-square polystyrene film 5 with the thickness of 50 μm used for the above-described measurement for the close contact force is 4.8 (N/mm$^2$)×30 mm×0.05 mm=7.2 N. The deformation force (shrink force) $F_S$ acts in a direction parallel to the surface of the film 5.

The inventors measures the maximum shrink stress generated by heating (65° C. to 75° C.) a polyethylene terephthalate film by using a stress measurement device (manufactured by Shimadzu Corporation, TMA-60), other than the polystyrene film. Consequently, the maximum shrink stress of the polyethylene terephthalate film with a thickness of 80 μm is about 2.6 (N/mm$^2$), the maximum shrink stress of the polyethylene terephthalate film with a thickness of 40 μm is about 5.0 (N/mm$^2$), and the maximum shrink stress of the polyethylene terephthalate film with a thickness of 25 μm is about 5.6 (N/mm$^2$). Accordingly, it is found that the maximum shrink stress by heating the polyethylene terephthalate film is a value substantially equivalent to that of the polystyrene film.

Consequently, as compared with the above-described value being about 26 (N) which is the close contact force $F_C$ of the film 5 with respect to the transport belt 43 at the temperature of 80° C., the measurement temperatures are 80° C. and 85° C. and hence there is a temperature difference of 5° C. However, referring to the characteristics shown in FIG. 6, the close contact force $F_C$ of the film 5 with respect to the elastic layer 432 of the transport belt 43 does not rapidly decrease by the temperature difference of 5° C. It is found that the close contact force $F_C$ of the film 5 serving as a continuous sheet closely contacting the elastic layer 432 of the transport belt 43 is larger than the deformation force $F_S$ generated at the film 5 ($F_C > F_S$).

Hence, in the fixing device 40, since the continuous sheet 5 formed of a film is transported while closely contacting the transport belt 43, the close contact force larger than the deformation force acts on the continuous sheet 5 against the deformation force generated at the continuous sheet 5 by heating.

Operation of Feature Portion (Fixing Device) of Image Forming Apparatus

If the control device 100 receives command information of a request for an image forming operation (print), the fixing device 40 is activated at a predetermined timing.

If the fixing device 40 receives the command information of the request for the image forming operation (print), electricity is applied to the halogen heater 414 of the heating roller 41, and the heating roller 41 is heated so that the surface temperature of the heating roller 41 becomes a predetermined temperature. When the surface temperature of the heating roller 41 reaches the predetermined temperature, the pressing roller 42 pressure contacts the heating roller 41, and the pressure roller 42 and the transport belt 43 are started to be rotationally driven.

Figure 8:
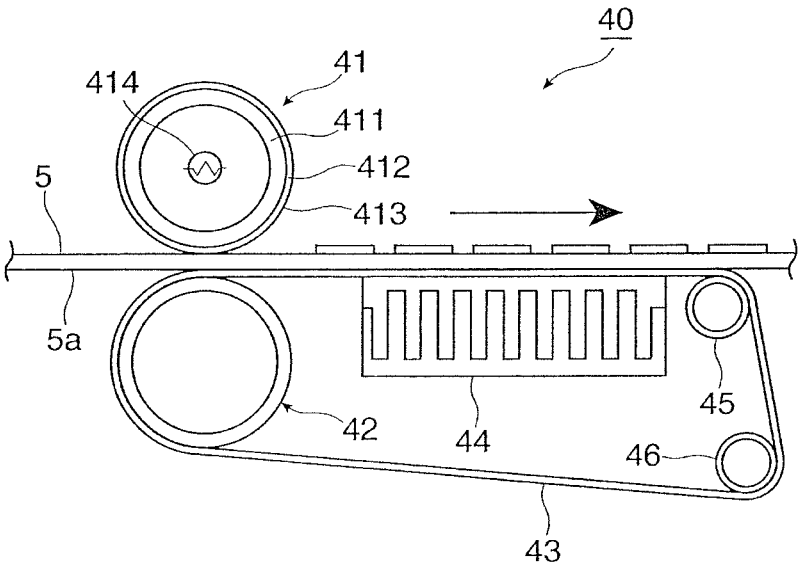
FIG. 8 is a configuration diagram showing an operation of the fixing device according to the first exemplary embodiment of the invention.

As shown in FIG. 8, if a toner image formed on a continuous sheet 5 by the image forming unit 106 of the image forming apparatus 1 reaches the nip part N of the fixing device 40, the unfixed toner image on the continuous sheet 5 receives heat from the heating roller 41 and a pressing force of the pressing roller 42, and hence the unfixed toner image is fixed onto the continuous sheet 5 when the toner image passes through the nip part N.

At this time, when the continuous sheet 5 is introduced to the nip part N of the fixing device 40, the no-image surface (back surface) 5*a* closely contacts the surface of the elastic layer 432 of the transport belt 43 wound around the pressing roller 42 by the pressing force of the pressing roller 42. While the continuous sheet 5 is at the nip part N, a shrink stress by heating acts on the continuous sheet 5. However, the continuous sheet 5 closely contacts the elastic layer 432 of the transport belt 43 by the pressure contact force of the heating roller 41 and the pressing roller 42, and is physically constrained.

After the continuous sheet 5 passes through the nip part N, the continuous sheet 5 moves at a predetermined belt moving speed toward the downstream side in the transport direction of the continuous sheet 5 together with the transport belt 43. When the continuous sheet 5 has passed through the nip part N, the heat from the heating roller 41 is stopped. Since the continuous sheet 5 has a thickness of 50 μm which is markedly smaller than that of normal paper, and has a larger thermal conductivity than that of normal paper. Hence, the continuous sheet 5 radiates heat to the air and to the transport belt 43 and the temperature of the continuous sheet 5 rapidly decreases. At this time, the close contact force $F_C$ continuously acts between a no-image surface 5*b* of the continuous sheet 5 and the surface of the elastic layer 432 of the transport belt 43 even after the continuous sheet 5 passes through the nip part N as shown in FIG. 7.

The close contact force $F_C$ of the continuous sheet 5 that closely contacts the surface of the elastic layer 432 of the transport belt 43 is temperature dependent as described above. However, the temperature of the continuous sheet 5 rapidly decreases after the continuous sheet 5 passes through the nip part. Owing to this, the close contact force $F_C$ in a range from about 10 to about 30 (N) per unit area of 30 mm×30 mm acts on the surface of the elastic layer 432 of the transport belt 43 even after the continuous sheet 5 passes through the nip part N. The close contact force $F_C$ is larger than 7.2 N (approximately calculated value) being the deformation force (shrink force) $F_S$ by heating acting on the continuous sheet 5 per the same unit area. Accordingly, the continuous sheet 5 maintains the state in close contact with the surface of the elastic layer 432 of the transport belt 43 even after the continuous sheet 5 passes through the nip part N, and the continuous sheet 5 is transported by the transport belt 43 toward the downstream side in the transport direction of the continuous sheet 5 without being separated from the elastic layer 432 of the transport belt 43.

Since the heat sink 44 is provided at the downstream side in the transport direction of the continuous sheet 5, the transport belt 43 and the continuous sheet 5 in close contact with the transport belt 43 are forcibly cooled by the heat sink 44. The continuous sheet 5 has a smaller thermal capacity than that of a recording medium such as normal paper; however, even when a toner image is fixed to the continuously transported long continuous sheet 5, the transport belt 43 does not store heat by providing the heat sink 44.

The continuous sheet 5 is separated from the transport belt 43 by the belt support roller (the separation roller) 45 and the fixing processing of the toner image is ended.

As described above, with the fixing device 40 according to this exemplary embodiment, deformation generated at the continuous sheet 5 by heating is prevented or reduced.

Second Exemplary Embodiment

Figure 9:
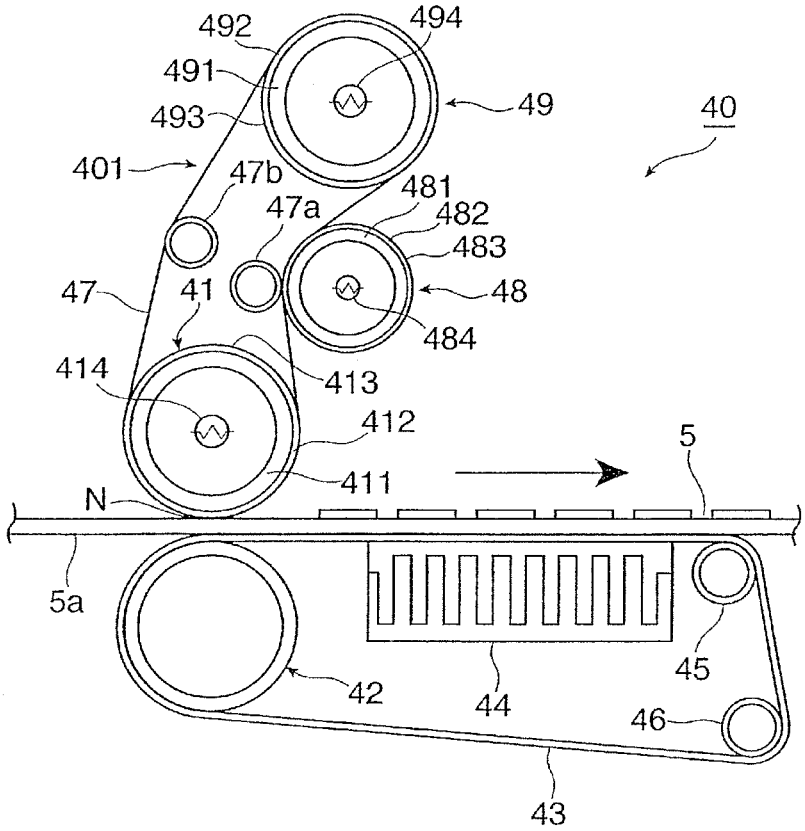
FIG. 9 is a configuration diagram showing a fixing device according to a second exemplary embodiment of the invention.

FIG. 9 illustrates a fixing device according to a second exemplary embodiment of the invention.

As shown in FIG. 9, a fixing device 40 according to the second exemplary embodiment includes a heating belt module 401 as an example of a heating unit, a pressing roller 42 as an example of a pressing unit arranged to be brought into contact with and separated from the heating belt module 401, and an endless transport belt 43 as an example of a transport member that closely contacts a no-image surface 5*a* of a continuous sheet 5 and transports the continuous sheet 5. A nip part N as a fixing processing unit is formed between the heating belt module 401 and the pressing roller 42. The nip processing unit heats and presses a continuous sheet 5 holding an unfixed toner image and hence fixes the unfixed toner image to the continuous sheet 5.

The heating belt module 401 includes a heating belt 47 formed in an endless belt; a heating roller 41 that is arranged in a fixed state to contact the inner peripheral surface of the heating belt 47 and causes the heating belt 47 to pressure contact the pressing roller 42; and plural support rollers 48, 49, 47*a*, and 47*b* that rotatably support the heating belt 47 while supporting the heating belt 47 with a tension. In this exemplary embodiment, a support roller among the plural support rollers 48, 49, 47*a*, and 47*b* also serves as a heating roller being a heating unit that heats the heating belt 47.

The plural support rollers 48, 49, 47*a*, and 47*b* include an outer heating roller 48 that heats the heating belt 47 from the outside while supporting the heating belt 47 with a tension; an inner heating roller 49 that heats the heating belt 47 from the inside while supporting the heating belt 47 with a tension; a first driven roller 47*a* arranged to contact the outer heating roller 48 through the heating belt 47; and a second driven roller (pre-nip roller) 47*b* that is arranged between the heating roller 41 and the inner heating roller 49 and holds the heating belt 47 in a desirable state.

Figure 10:
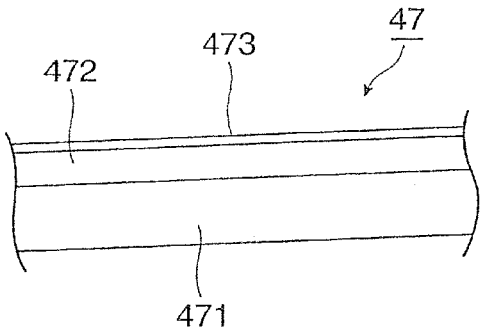
FIG. 10 is a cross-sectional configuration diagram showing a heating belt.

As shown in FIG. 10, the heating belt 47 is formed of a flexible endless belt, and includes, for example, a base (base member) layer 471 formed of polyimide resin, an elastic layer 472 formed of silicone rubber stacked on the surface (outer peripheral surface side) of the base layer 471; and a release layer 473 formed of tetrafluoroethylene-perfluoroalkylvinilether copolymer (PFA) covering the surface of the elastic layer 472. For the configuration of the heating belt 47, the material, thickness, hardness, etc., may be properly selected in accordance with the conditions requested to the fixing device 40, such as the purpose of use, use condition, etc. In this exemplary embodiment, an elastic layer 472 is provided on the surface of the base layer 471 to improve the image quality of a color image. Since the continuous sheet 5 with toners of respective colors made of powder laminated passes through the nip part N that is a pressure contact region where pressure contact is provided between the heating belt module 401 and the pressing roller 42, the elastic layer 472 of the heating belt 47 is deformed by following the toner images on the continuous sheet 5, and hence the heat may be supplied entirely to the toner images.

Also, the outer heating roller 48 includes, for example, a cylindrical core metal member 481 formed of aluminum, stainless steel, or iron. An elastic layer 482 formed of a heat-resistant elastic body such as silicone rubber and a release layer 483 made of fluorocarbon resin are formed on the surface of the outer heating roller 48. A single halogen heater 484 or plural halogen heaters 484 are arranged as a heating source arranged in the outer heating roller 48. The halogen heater 484 heats the surface of the outer heating roller 48 to a predetermined temperature (for example, 190° C.). Also, spring members (not shown) that press the heating belt 47 inward are arranged at both end portions in the axial direction of the outer heating roller 48. The spring members set the entire tension of the heating belt 47 at, for example, 15 kgf.

Also, the inner heating roller 49 includes, for example, a cylindrical core metal member 491 formed of aluminum, stainless steel, or iron. An elastic layer 492 formed of a heat-resistant elastic body such as silicone rubber and a release layer 493 made of fluorocarbon resin are formed on the surface of the inner heating roller 49. A single halogen heater 494 or plural halogen heaters 494 are arranged as a heating source arranged in the inner heating roller 49. The halogen heater 494 heats the surface of the inner heating roller 49 to a predetermined temperature (for example, 190° C.). Also, a meandering control device (not shown) is provided as a meandering control unit at the inner heating roller 49. The meandering control device controls meandering of the heating belt 47. The meandering control device includes a detector (end-portion sensor, not shown) that detects the position of an end portion in the width direction of the heating belt 47. Meandering of the heating belt 47 is controlled by moving a first end portion in the axial direction of the inner heating roller 49 in a direction intersecting with the axial direction in accordance with information of the end-portion position of the heating belt 47 detected by the detector.

In this exemplary embodiment, the heating roller 41, the outer heating roller 48, and the inner heating roller 49 heat the heating belt 47; however, it is not limited thereto. The number of heating rollers that heat the heating belt 47 may be desirably set.

As described above, the heating belt 47 is a member formed in an endless belt shape and has a smaller thermal capacity than a roll-shaped heating member. The surface temperature of the heating belt 47 is heated to a predetermined temperature while the heating belt 47 passes the heating roller 41, the outer heating roller 48, and the inner heating roller 49. Accordingly, in a high-speed device with the transport speed of the continuous sheet 5 being high, the temperature of the heating belt 47 may be recovered to a fixing temperature while the heating belt 47 makes one turn. Also, the heating roller 41, the outer heating roller 48, and the inner heating roller 49 each are arranged to contact the heating belt 47 with a large area (large winding angle). The inner peripheral surface and the outer peripheral surface of the heating belt 47 are efficiently heated.

Third Exemplary Embodiment

Figure 11:
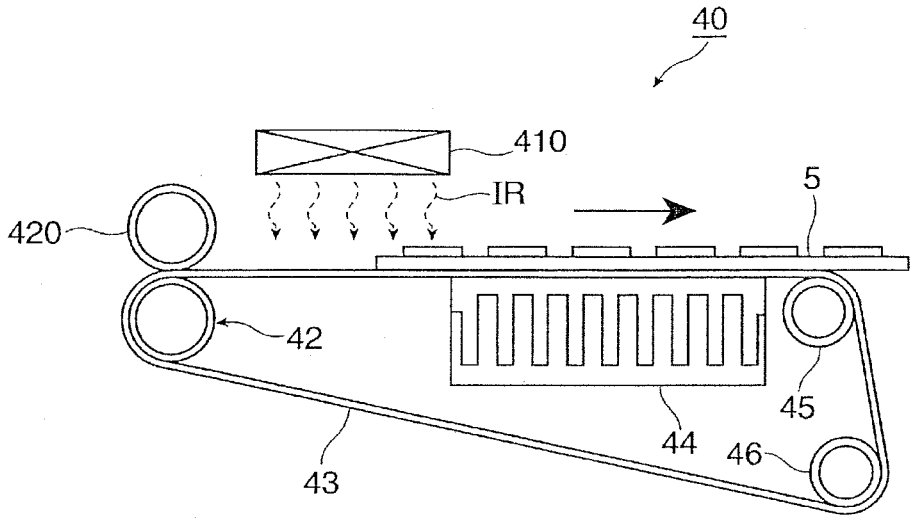
FIG. 11 is a configuration diagram showing a fixing device according to a third exemplary embodiment of the invention.

FIG. 11 illustrates a fixing device according to a third exemplary embodiment.

As shown in FIG. 11, a fixing device 40 according to the third exemplary embodiment uses a non-contact heating source 410 instead of contact type in which a heating unit is formed of a heating roller or a heating belt. The heating source 410 executes heating by irradiation with light rays IR such as laser light or flash light.

Also, the fixing device 40 includes an auxiliary pressing roller 420 at the upstream side of the heating source 410 in the transport direction of the continuous sheet 5. The auxiliary pressing roller 420 pressure contacts the pressing roller 42 so that the continuous sheet 5 closely contacts the transport belt 43.

In the third exemplary embodiment, if the continuous sheet 5 is a transparent film, a toner image on the continuous sheet 5 may be selectively heated. Hence, the temperature of the continuous sheet 5 may be prevented from increasing, and a decrease in close contact force $F_C$ caused by an increase in temperature of the continuous sheet 5 and the transport belt 43 may be restricted.

Fourth Exemplary Embodiment

Figure 12:
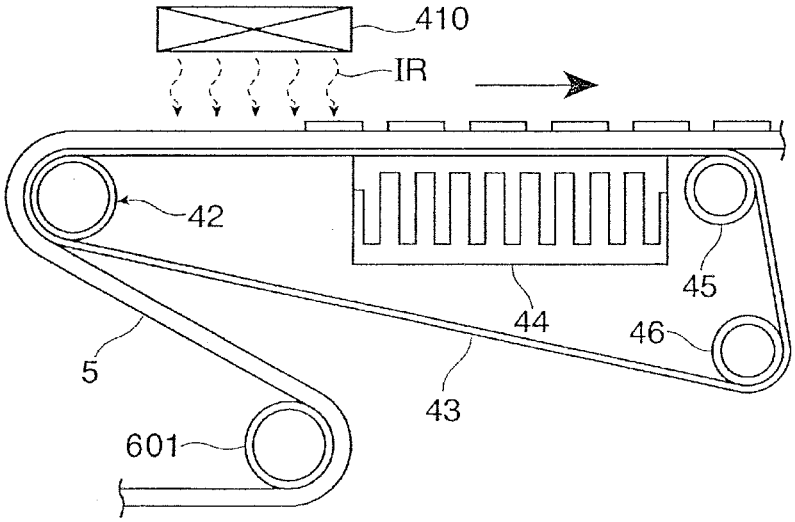
FIG. 12 is a configuration diagram showing a fixing device according to a fourth exemplary embodiment of the invention.

FIG. 12 illustrates a fixing device according to a fourth exemplary embodiment.

As shown in FIG. 12, in a fixing device 40 according to the fourth exemplary embodiment, an auxiliary transport roller 601 is arranged below the pressing roller 42, at the upstream side in the transport direction of the continuous sheet 5. The auxiliary transport roller 601 causes the continuous sheet 5 to pressure contact the pressing roller 42. Hence, the auxiliary pressing roller is not required, and the configuration of the fixing device 40 is simplified.

Fifth Exemplary Embodiment

Figure 13:
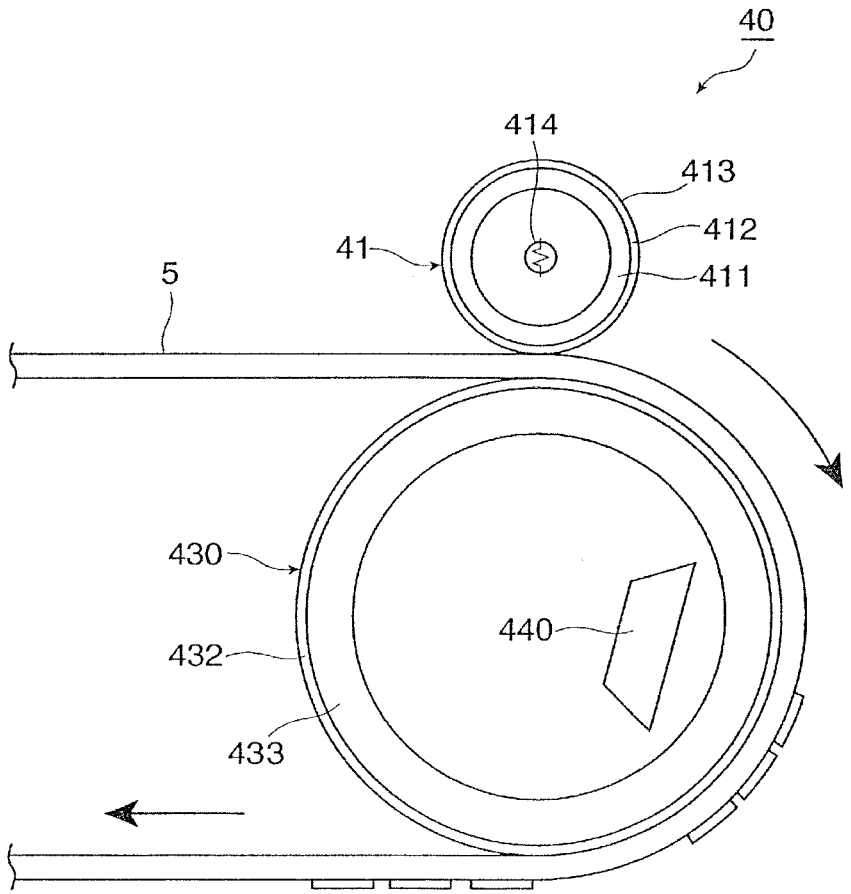
FIG. 13 is a configuration diagram showing a fixing device according to a fifth exemplary embodiment of the invention.

FIG. 13 illustrates a fixing device according to a fifth exemplary embodiment.

As shown in FIG. 13, a fixing device 40 according to the fifth exemplary embodiment uses a cylindrical transport roller 430 as a transport member instead of an endless belt. The transport roller 430 includes a core metal member 433 formed in a cylindrical shape with metal, such as aluminum, stainless steel, or iron; and an elastic layer 432 covering the surface of the core metal member 433 by a predetermined thickness. As the elastic layer 432 of the transport roller 430, a layer formed by applying and solidifying the product named "SIFEL" (2000 series) being liquid-form elastic polymer manufactured by Shin-Etsu Chemical Co., Ltd. is used.

The continuous sheet 5 is wound to be returned to the transport roller 430. Since the transport roller 430 has a larger thermal capacity than that of the transport belt and the transport roller 430 contacts the heating roller 41, an air cooling unit 440 such as a cooling fan having a high cooling effect for forcibly cooling the transport roller 430 is provided.

In this exemplary embodiment, the transport member is configured of the transport roller 430 and hence the fixing device 40 is compact.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a heating unit that heats an unfixed image on a recording medium, which is deformed by heating, and hence fixes the unfixed image; and a transport member that closely contacts a no-image surface of the recording medium and transports the recording medium while causing a close contact force to act on the recording medium against a deformation force, which is generated at the recording medium by the heating of the heating unit, wherein the close contact force of the recording medium with respect to the transport member is larger than the deformation force generated at the recording medium, wherein the transport member has a base member and an elastic layer at a surface that contacts the recording medium, the elastic layer having a larger close contact force than a close contact force of the base member.

2. A fixing device, comprising:

a heating unit that heats an unfixed image on a recording medium, which is deformed by heating, and hence fixes the unfixed image;

a transport member that transports the recording medium while closely contacting a no-image surface of the recording medium; and cooling unit that is arranged at an inner periphery side of the transport member and cools the no-image surface of the recording medium heated by the heating unit, through the transport member, wherein the transport member has a base member and an elastic layer at a surface that contacts the recording medium, the elastic layer having a larger close contact force than a close contact force of the base member.

3. The fixing device according to claim 1, further comprising:

a pressing unit that presses the recording medium toward the transport member, wherein the pressing unit is arranged at a position being the same as a position of the heating unit or is arranged upstream of the heating unit in a transport direction of the recording medium.

4. The fixing device according to claim 1, further comprising:

a cooling unit that is arranged downstream of the heating unit in a transport direction of the recording medium, and cools the recording medium through the transport member, wherein the transport member continuously causes a close contact force to act until the recording medium reaches at least the cooling unit.

5. The fixing device according to claim 1, further comprising:

a cooling unit that is arranged downstream of the heating unit in a transport direction of the recording medium, and cools the recording medium through the transport member, wherein the transport member continuously causes a close contact force to act until the recording medium is cooled to a temperature at which the recording medium is not deformed.

6. The fixing device according to claim 1, wherein the close contact force includes a static friction force and an adhesive force.

7. The fixing device according to claim 1, wherein the transport member has a surface that contacts the recording medium, the surface being made of an insulating material, and wherein the fixing device further comprises an electrostatic attraction force applying unit that causes an electrostatic attraction force to act between the recording medium and the transport member.

8. An image forming apparatus, comprising:

an image forming unit that forms an image on a recording medium, which is deformed by heating; and a fixing unit that fixes the unfixed image formed by the image forming unit onto the recording medium, wherein the fixing device according to claim 1 is used as the fixing unit.

* * * * *